US005576671A

United States Patent [19]

Agar, Jr. et al.

[11] Patent Number: 5,576,671

[45] Date of Patent: Nov. 19, 1996

[54] METHOD AND APPARATUS FOR POWER COMBINING/DIVIDING

[75] Inventors: Bill T. Agar, Jr., Chandler; David W. Corman, Gilbert; Kenneth V. Buer, Chandler, all of Ariz.

[73] Assignee: Motorola, Inc., Schaumburg, Ill.

[21] Appl. No.: 427,323

[22] Filed: Apr. 24, 1995

[51] Int. Cl.[6] ..... H01P 5/12

[52] U.S. Cl. ..... 333/128; 330/295; 333/161

[58] Field of Search ..... 333/128, 124, 333/127, 136, 156, 160, 161; 330/295

[56] References Cited

U.S. PATENT DOCUMENTS

| | | | |
|---|---|---|---|
| 2,877,427 | 3/1959 | Butler | 333/128 |
| 4,263,559 | 4/1981 | Ho | 330/53 |
| 4,310,814 | 1/1982 | Bowman | 333/128 X |
| 4,323,863 | 4/1982 | Weber | 333/156 X |
| 4,356,462 | 10/1982 | Bowman | 333/128 |
| 4,463,326 | 7/1984 | Hom | 333/128 |
| 4,543,545 | 9/1985 | Craine et al. | 333/128 |
| 4,547,745 | 10/1985 | Freitag | 330/286 |
| 4,712,024 | 12/1987 | McGuire et al. . | |
| 4,721,929 | 1/1988 | Schnetzer | 333/127 |
| 4,875,024 | 10/1989 | Roberts | 333/128 X |
| 4,965,527 | 10/1990 | Clark et al. | 330/124 |
| 4,968,958 | 11/1990 | Hoare | 333/128 |
| 5,126,704 | 6/1992 | Dittmer et al. | 333/128 X |
| 5,311,155 | 5/1994 | Blodgett | 333/156 X |

FOREIGN PATENT DOCUMENTS

| | | | |
|---|---|---|---|
| 70731 | 6/1977 | Japan | 333/128 |

OTHER PUBLICATIONS

An article entitled "An N-Way Broadband Planar Power Combiner/Divider" by W. Yau et al., *Microwave Journal*, Nov. 1986, pp. 147–151.

*Primary Examiner*—Paul Gensler

*Attorney, Agent, or Firm*—Bradley J. Botsch, Sr.; Jeffrey D. Nehr

[57] ABSTRACT

A method and apparatus for power combining or dividing handles high impedance line requirements in n-way combiners (15) and dividers (10) using phase delay networks (12, 14) to transform impedances to a lower, intermediate impedance. Each impedance transformation is accomplished using a stepped impedance or tapered impedance transmission line (26). The method and apparatus provides isolation between input or output ports (11, 22 and 24, 13) in power combining or dividing circuits using an incremental phase delay network (12) of prescribed electrical phase lengths (22, 24) to provide phase cancellation. The power divider (10) and combiner (15) can be used in power amplifiers and in communication devices.

14 Claims, 3 Drawing Sheets

METHOD AND APPARATUS FOR POWER COMBINING/DIVIDING

FIELD OF THE INVENTION

This invention relates in general to the field of electrical power combining and dividing, and specifically to the area of microwave power combiners and dividers.

BACKGROUND OF THE INVENTION

Power combiners and dividers are often used in high power microwave and RF amplifiers. While traditional power combiners are well known, the need exists for a low loss, small size, n-way (where n is any positive integer) planar power combiner with high adjacent port isolation suitable for uses such as in the IRIDIUM® low-earth orbit satellite cellular communication system.

Several well known power divider and power combiner topologies exist. The most common binary ($2^n$-way) method to provide high isolation power combining is by combining 2-way power combiners to form a $2^n$-way power combiner. The problem with this method is high combiner loss from using multiple 2-way power combiners or dividers. The power loss in this type of combiner or divider is proportional to the number of levels (the number of times two ports are split or combined) needed to realize the combiner.

Another method is to use the well-established Wilkinson n-way power combiner. A disadvantage of this method is that, as n gets large, the output line impedance becomes too high to be realizable. For example, consider a 4-way power combiner or divider requiring a line impedance of 100 ohms. Current n-way power dividers are designed to match n impedances directly to the 50 ohm input. For example, to split or combine a signal n-ways, the n-way paths must be transformed from 50 ohms to 50 times n ohms. For a 6-way combiner/divider, a transformation from 50 ohms to 300 ohms is required. Generally, a quarter wave line of an impedance of $[50*(50*n)]^{0.5}$ is used for transforming from 50 ohms to 50*n ohms. For the 6-way, a 123 ohm quarter wave line is required, but not feasible in most microstrip substrates because of its extremely small line width.

A structure referenced in the article "An N-way Broadband Planar Power Combiner/Divider" by Yau, W. and Schellenberg, J. M., Microwave Journal, November 1986 transforms a 50 ohm input to a total n-way load of 50/n using a Dolph-Chebyshev tapered transmission line. The line is segmented to form n output ports. Isolation resistors are placed between the segmented output ports to achieve isolation between the output ports. Disadvantages inherent in this structure include the following:

a. The structure cannot accommodate large power amplifier chips because each segmented output port relies on the coupling between lines to keep the integrity of the Dolph-Chebyshev tapered line;

b. Isolation resistors limit the structure's highest operating frequency and power handling capability;

c. If isolation resistors are removed to accommodate higher operating frequencies and power handling capability, the structure will not lend itself to soft failures; and d. The structure voltage standing wave ratio (VSWR) tolerance to variations in loads is very poor.

What is needed is a planar n-way power combiner or divider that accommodates larger amplifier chips, provides good port-to-port isolation, and is not limited to low microwave frequency realizations.

DETAILED DESCRIPTION OF THE DRAWINGS

Figure 1:
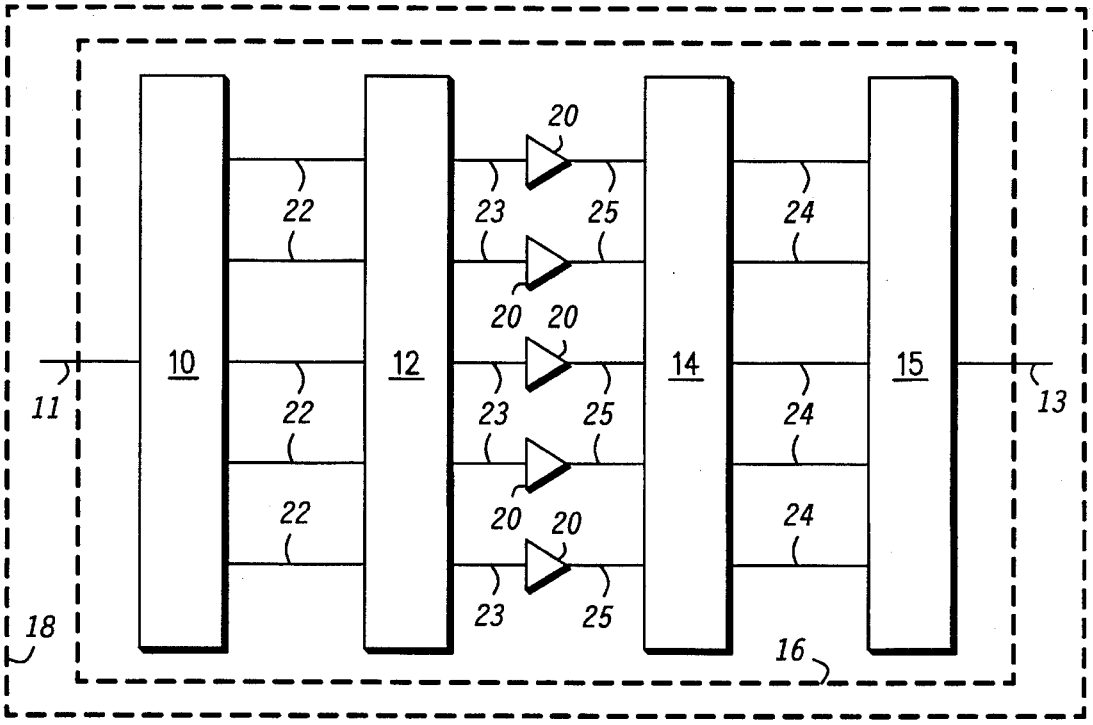
FIG. 1 illustrates a schematic of a communication system containing a power amplifier assembly including power dividing and power combining in accordance with the preferred embodiment of the invention.

FIG. 1 illustrates schematically a communication system 18 containing a power amplifier 16 which can be comprised of a stepped or tapered impedance power divider 10, an input phase delay network 12, a plurality of power amplifiers 20, an output phase delay network 14, and a power combiner 15. Power divider 10 has an input port 11 which receives the power signal to be processed. The power divider outputs 22 of power divider 10 are input phase delay network 12. A plurality of phase delay signals from phase delay network outputs 23 are input to power amplifiers 20. Power amplifier outputs 25 comprising a plurality of amplified signals are input to phase delay network 14. A plurality of phase delay signals from the phase delay network outputs 24, which are inverse phase transformations compared to those produced by phase delay network 12, are input to power combiner 15, where they are combined to exit from output port 13 as a power combined output signal.

To overcome the problem of realizing high impedance transmission lines in n-way power combiners, the stepped or tapered impedance power combiner or divider 10 first transforms an input port 11 impedance to a lower impedance so that the high impedance line requirement becomes feasible. While a 5-way division is shown in FIG. 1, "n" is not restricted. For example, in a 6-way division, a 50 ohm input port 11 impedance can first be transformed to 16 ohms. In this example, the required impedance of each $Z_{xf2}$ (defined below) will be about 100 ohms. Therefore, a transformation from 100 ohms to 50 ohms is required, which is easily implemented in most microstrip substrates. To extend the bandwidth of the invention, stepped or tapered transmission lines are used to perform the impedance transformation, as is described below.

Figure 2:
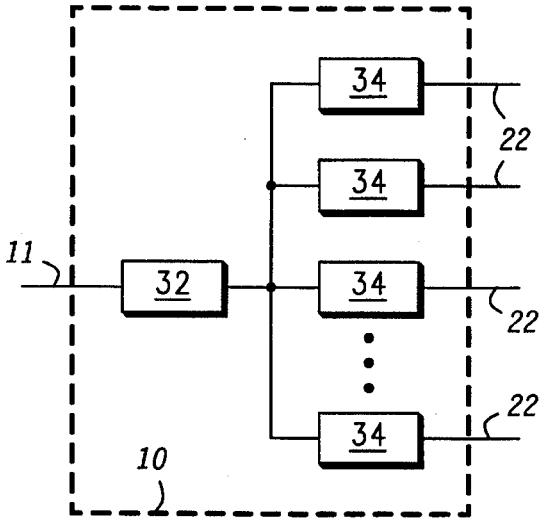
FIG. 2 is a schematic of a power divider/combiner in accordance with a preferred embodiment of the invention.

FIG. 2 is a schematic of the stepped or tapered impedance power combiner 15 or divider 10 in accordance with a preferred embodiment of the invention (the device is a power divider if a single power signal is input to port 11 with a plurality of divided power signals exiting at ports 22; the device is a power combiner if a plurality of input signals are input to ports 22 with a single combined power signal exiting at port 11). FIG. 2 includes impedance transformer elements 32 and 34 which can be planar transmission lines in the preferred embodiment. Port 11 is coupled to a first side of impedance transformer element 32; a second side of impedance transformer element 32 is coupled in parallel to a first side of n impedance transformer elements 34. A second side of each of the n impedance transformer elements 34 comprises ports 22.

The impedances in the FIG. 2 power divider/combiner 10 are as follows: at port 11, looking away from the power divider/combiner 10 is impedance $Z_s$ and looking into the power/combiner 10 is impedance $Z_{in}$; between impedance transformer elements 32 and 34 looking toward impedance transforming element 32 is impedance $Z_{xf1}$ and looking toward each impedance transforming element 34 is impedance $Z_{xf2}$, where $Z_{xf2}/n=Z_{xf1}$; and, at ports 22 looking away from the power divider/combiner 10 is impedance $Z_{out}$ and looking toward the power divider/combiner 10 is impedance $Z_{load}$.

To perfectly match the port 11 and ports 22 of the stepped or tapered impedance power combiner 15 or divider 10, the input phase delay network 12 and output phase delay network 14 in FIG. 1 are added so that signal reflections from each branch of the division are canceled out at the input port 11 and output port 13. With signal reflections canceled, the input and output impedance match is independent of the input and output voltage standing wave ratio (VSWR) of each of the plurality of power amplifier devices 20.

Figure 3:
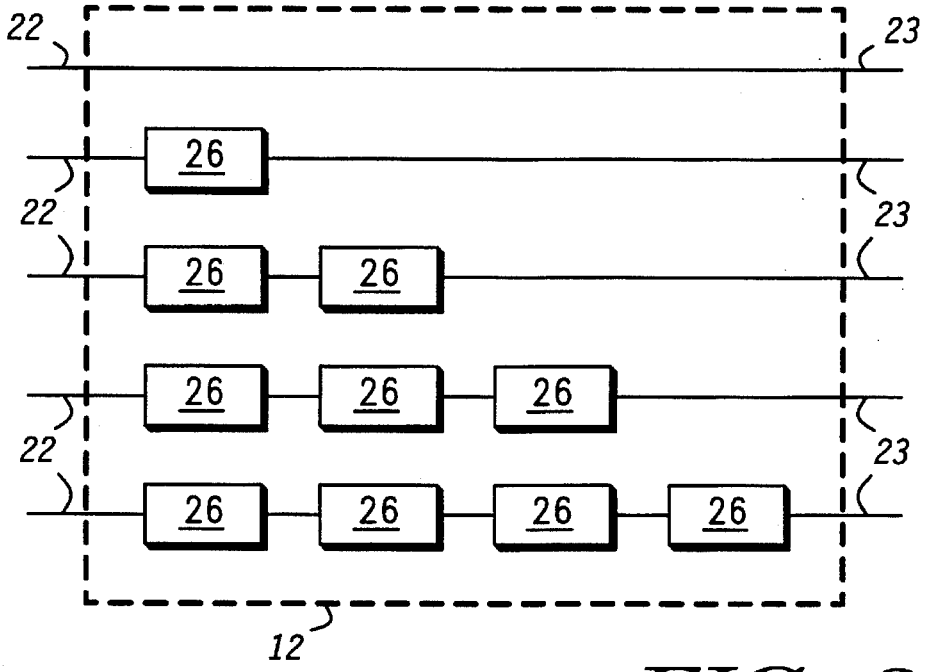
FIG. 3 is a schematic of a phase delay network in accordance with a preferred embodiment of the invention.

FIG. 3 is a schematic of an input phase delay network to present a perfect match and high isolation at the input in accordance with a preferred embodiment of the invention. In FIG. 3, the input phase delay network 12 and output phase delay network 14 are comprised of a plurality of transmission line elements 26 with the characteristic impedance of $Z_{load}$. Each of the five lines or branches of the phase delay network has an electrical length that varies in a stepped fashion between power divider outputs 22 (these are also the phase delay network inputs) and the power amplifier inputs 23 (these are also the phase delay network outputs-refer to FIG. 1). Each branch of the 5-way division shown in FIG. 3, for example, has an electrical length θ longer than the preceding line and θ shorter than the next line, achieved by inserting transmission line elements 26, where θ=180 degrees divided by 5 (n=5 in the FIG. 3 case). Thus, the top branch of the 5-way division has no transmission line elements 26 inserted, and the bottom branch of the 5-way division includes 4 transmission line elements 26. It is this varying characteristic impedance in each branch that provides phase delay.

Figure 4:
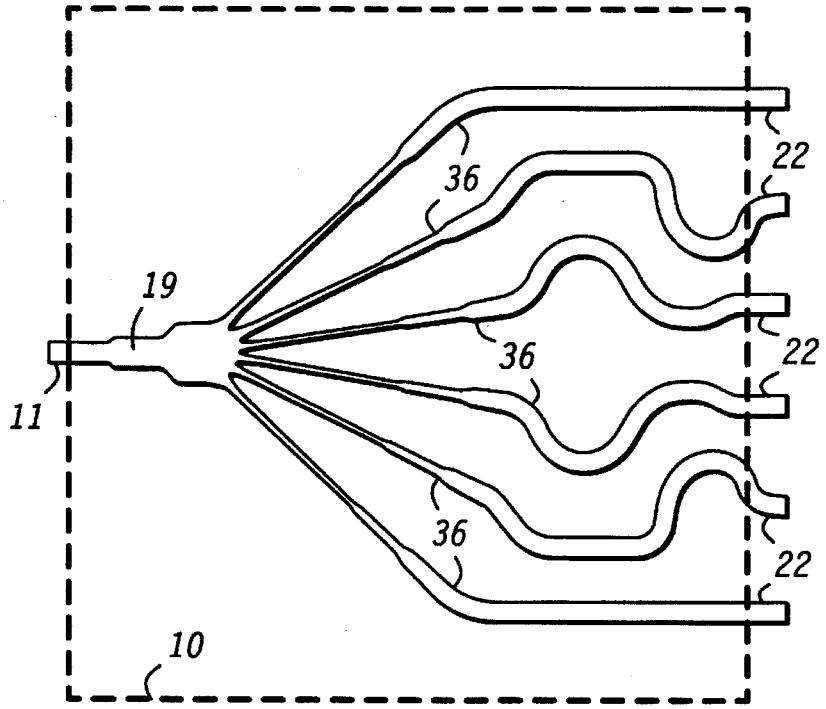
FIG. 4 is a top view of a stepped transmission line power divider with an output phase delay network in accordance with a preferred embodiment of the invention.

FIG. 4 is a schematic of a 6-way stepped impedance power divider 10 with stepped transmission lines 36 in accordance with a preferred embodiment of the invention. The power divider 10 receives a single input signal at input port 11 and produces a divided signal at output ports 22. From input port 11, the impedance of transmission line 19 is stepped to an intermediate characteristic impedance (at a common node end of transmission line 19) before 6-way branching to transmission lines 36. Each branch of the stepped impedance power divider 10 comprises a stepped transmission line 36 between the intermediate characteristic impedance point and power divider outputs 22. The power divider 10 can be fabricated on a standard board with standard materials, including substrate, such as a 0.0254 millimeter (10 mil) RT 6002 Duroid board, available from Rogers Corporation, Soladyne Division, in San Diego, Calif.

Using conventional analysis and simulation techniques such as Hewlett-Packard-EESOF Libra Series IV, Version 5 available from Hewlett Packard in Westlake Village, Calif., the FIG. 4 stepped impedance power divider 10 can be modeled as in FIG. 2, with the stepped input transmission line 19 in FIG. 4 corresponding to 3 series elements of planar impedance transformer 22 in FIG. 2 and stepped transmission lines 36 in FIG. 4 corresponding to planar impedance transformers 34 in FIG. 2. To create a maximally flat design in the preferred embodiment in transforming 50 ohms to 16.7 ohms, the stepped input transmission line 19 can be modeled by a series combination of five (=n) impedances, $Z_1$, $Z_2$, $Z_3$, $Z_4$, and $Z_5$, where $Z_1$=17.28 ohms, $Z_2$=20.52 ohms, $Z_3$=28.93 ohms, $Z_4$=40.78 ohms and $Z_5$=48.42 ohms. The impedances are arrived at from the relation:

$$\ln(Z_{i+1}/Z_i)=a_i \ln(R)/\Sigma a_i$$

where $a_i$ are binomial expansion coefficients in the ratios:

$$a_0:a_1:a_2:a_3:a_4:a_5, \text{ or } 1:5:10:10:5:1,$$

$R=Z_s/Z_0=3$, where $Z_s$ is source impedance, $Z_0$ is output impedance, and the $\Sigma\ a_i=1+5+10+10+5+1=32$. Similar analysis for stepped transmission lines 36, for n=5, $Z_0$=50 ohms, $Z_s$=100 ohms, R=2, and $$a_0:a_1:a_2:a_3:a_4:a_5, \text{ or } 1:5:10:10:5:1,$$

yields $Z_1$=51.09 ohms, $Z_2$=56.93 ohms, $Z_3$=70.70 ohms, $Z_4$=87.81 ohms, and $Z_5$=97.85 ohms.

Figure 5:
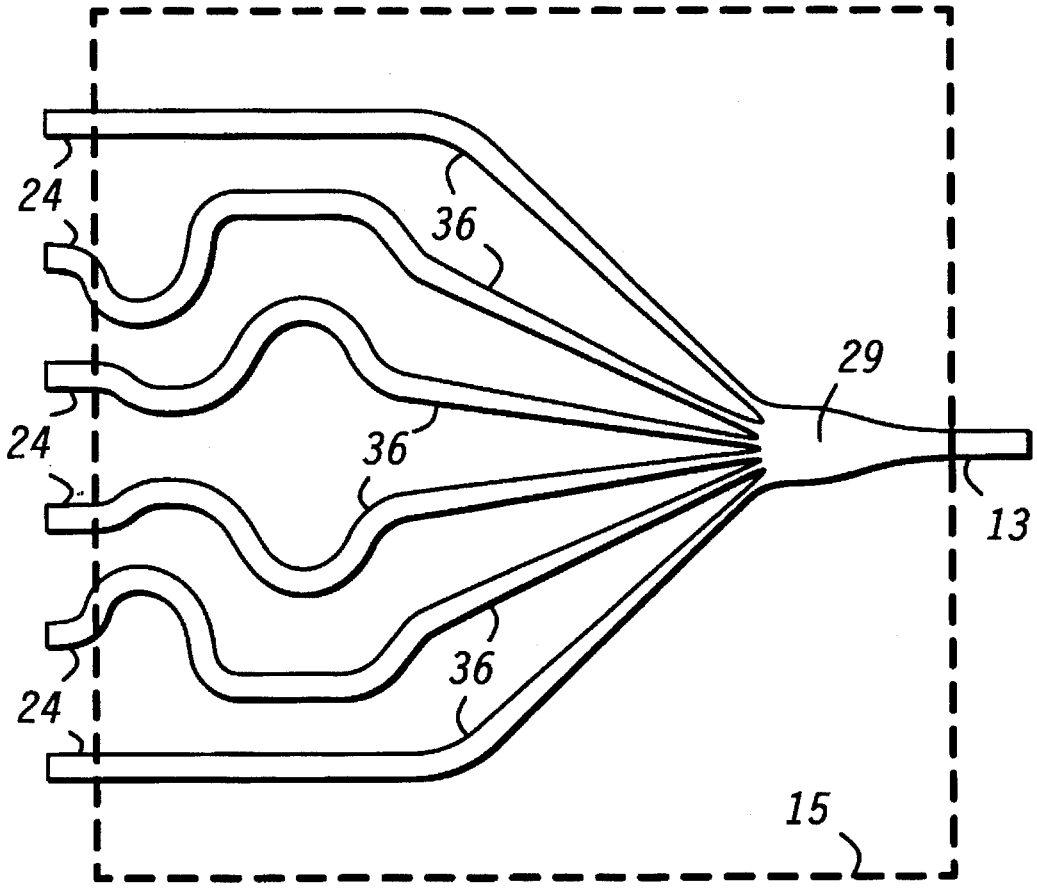
FIG. 5 is a top view of a tapered transmission line power combiner with an output phase delay network in accordance with a preferred embodiment of the invention.

FIG. 5 is a schematic of a 6-way tapered impedance power combiner 15 with tapered transmission lines 36 in accordance with a preferred embodiment of the invention. As in the FIG. 4 divider 10, conventional materials can be used. Each branch of the power combiner 15 comprises a tapered transmission line 36 between power combiner inputs 24 and power combiner output port 13. Conventional methods of analysis can be used to determine the taper of transmission lines 36 to achieve appropriate impedance matching. A plurality of input signals to the combiner input 24 on the plurality of transmission lines 36 combine to form a combined signal at an end (common node) of a transmission line 29 which is itself tapered to vary characteristic impedance from its input to its output.

The method and apparatus described herein are potentially usable in conjunction with any application that requires n-way power combining or dividing functions at microwave or millimeter microwave frequencies and low cost high power amplifier modules using MMICs. The following significant improvements are achieved by using a method and apparatus in accordance with a preferred embodiment of the invention. Unrealizable high impedance lines typically encountered in n-way power dividers/combiners can be avoided. The method and apparatus are insensitive to imbedded device input/output VSWR much like that provided by quadrature hybrid combining but without the requirement of being $2^n$-way division/combination. The present method and apparatus lend themselves to any n-way power divider/combiner (including 3-way, 4-way, etc.). The method and apparatus result in low loss, since they do not use a cascaded transmission line of 2-way or 3-ways to form an n-way power divider/combiner. High output powers can be sustained. No series or shunt resistors, which can limit output power handling capabilities, are used. Transmission lines may be spread out to accommodate various MMIC chip sizes. The method and apparatus provide a "soft failure" function if one or more of the ports become a short or open. The method and apparatus allow for a planar structure with layout flexibility which can be easily fabricated and implemented on microstrip, which is an inexpensive medium compared to waveguide structures which generally is used at the frequencies of interest here. The method and apparatus further extend the useful frequency range by eliminating isolation resistors that have limited frequency range.

Thus, there has been provided, in accordance with the preferred embodiment of the invention, a method and apparatus for power combiner or divider that can accommodate larger amplifier chips, that provides good port to port isolation, and that is not limited to low frequency realizations that fully satisfies the aims and advantages set fourth above. While the invention has been described in conjunction with a specific preferred embodiment, many alternatives, modifications, and variations will be apparent to those of ordinary skill in the art in light of the forgoing description. Accordingly, the invention is intended to embrace all such alternatives, modifications, and variations as fall within the spirit of the claims.

What is claimed is:

1. A power combiner for adding a plurality of input signals to produce a single output signal, the power combiner comprising:

a substrate;

a phase delay network on the substrate, the phase delay network comprising a plurality of parallel coupled transmission line elements, having an electrical length θ longer than a preceding line and θ shorter than a next line, where θ=180 degrees divided by n, and n is a number of the plurality of input signals to be combined;

a plurality of input transmission lines each having an input characteristic impedance and each comprised of a serial combination of varying characteristic impedances on the substrate, wherein the plurality of input transmission lines receive the plurality of input signals from the plurality of transmission line elements in the phase delay network at first ends and combine the plurality of input signals into a combined signal at a second end comprising a common node with an intermediate characteristic impedance; and an output transmission line comprised of a serial combination of varying characteristic impedances on the substrate, wherein the output transmission line receives the combined signal at a first end and produces the combined signal at a second end with an output characteristic impedance wherein the intermediate characteristic impedance is an intermediate impedance between the input characteristic impedance of the plurality of input transmission lines and the characteristic impedance of the output transmission line.

2. A power combiner as claimed in claim 1, wherein the plurality of input transmission lines and the output transmission line are tapered and planar.

3. A power combiner as claimed in claim 1, wherein the plurality of input transmission lines and the output transmission line are stepped and planar.

4. A power divider for dividing a single input signal to produce a plurality of output signals, the power divider comprising:

a substrate;

an input transmission line having an input characteristic impedance and comprised of a serial combination of varying characteristic impedances on the substrate, wherein the input transmission line receives the single input signal at a first end and produces the single input signal at a common node with an intermediate characteristic impedance;

a plurality of output transmission lines each comprised of a serial combination of varying characteristic impedances on the substrate, wherein the plurality of output transmission lines receive the single input signal at a first end and produce a divided signal at second ends with an output characteristic impedance wherein the intermediate characteristic impedance is an intermediate impedance between the input characteristic impedance of the input transmission line and the characteristic impedance of each of the plurality of output transmission lines;

a phase delay network on the substrate, the phase delay network comprising a plurality of parallel coupled transmission line elements, each having an electrical length θ longer than a preceding line and θ shorter than a next line, where θ=180 degrees divided by n, and n is a number into which the single input signal to be divided, wherein the plurality of transmission line elements receives the divided signal at the second ends.

5. A power divider as claimed in claim 4, wherein the input transmission line and the plurality of output transmission lines are tapered and planar.

6. A power divider as claimed in claim 4, wherein the input transmission line and the plurality of output transmission lines are stepped and planar.

7. A power amplifier including a power combiner for adding a plurality of input signals to produce a single output signal, the power combiner comprising:

a substrate;

a phase delay network on the substrate, the phase delay network comprising a plurality of parallel coupled transmission line elements, each having an electrical length θ longer than a preceding line and θ shorter than a next line, where θ=180 degrees divided by n, and n is a number of the plurality of input signals to be combined;

a plurality of input transmission lines each having an input characteristic impedance and each comprised of a serial combination of varying characteristic impedances on the substrate, wherein the plurality of input transmission lines receive the plurality of input signals from the plurality of transmission line elements in the phase delay network at first ends and combine the plurality of input signals into a combined signal at a second end comprising a common node with an intermediate characteristic impedance; and an output transmission line comprised of a serial combination of varying characteristic impedances on the substrate, wherein the output transmission line receives the combined signal at a first end and produces the combined signal at a second end with an output characteristic impedance wherein the intermediate characteristic impedance is an intermediate impedance between the input characteristic impedance of the plurality of input transmission lines and the characteristic impedance of the output transmission line.

8. A power amplifier as claimed in claim 7, wherein the plurality of input transmission lines and the output transmission line are tapered and planar.

9. A power amplifier as claimed in claim 7, wherein the plurality of input transmission lines and the output transmission line are stepped and planar.

10. A power amplifier including a power divider for dividing a single input signal to produce a plurality of output signals, the power divider comprising:

a substrate;

an input transmission line having an input characteristic impedance and comprised of a serial combination of varying characteristic impedances on the substrate, wherein the input transmission line receives the single input signal at a first end and produces the single input signal at a common node with an intermediate characteristic impedance;

a plurality of output transmission lines each comprised of a serial combination of varying characteristic impedances on the substrate, wherein the plurality of output transmission lines receive the single input signal at a first end and produce a divided signal at second ends with an output characteristic impedance wherein the intermediate characteristic impedance is an intermediate impedance between the input characteristic impedance of the input transmission line and the characteristic impedance of each of the plurality of output transmission lines;

a phase delay network on the substrate, the phase delay network comprising a plurality of parallel coupled transmission line elements, each having an electrical length θ longer than a preceding line and θ shorter than a next line, where θ=180 degrees divided by n, and n is a number into which the single input signal to be divided, wherein the plurality of transmission line elements receives the divided signal at the second ends.

11. A power amplifier as claimed in claim 10, wherein the input transmission line and the plurality of output transmission lines are tapered and planar.

12. A power amplifier as claimed in claim 10, wherein the input transmission line and the plurality of output transmission lines are stepped and planar.

13. A method of dividing a single input power signal to two or more devices comprising the steps of:

transforming an input characteristic impedance to an intermediate characteristic impedance using a transmission line of characteristic impedance $Z_{xf1}$;

distributing power to the two or more devices using two or more transmission lines of characteristic impedance $Z_{xf2}$, wherein each transmission line provides a divided signal and wherein $Z_{xf1}=Z_{xf2}/n$ and the intermediate characteristic impedance is an intermediate impedance between the input characteristic impedance and the characteristic impedance of the two or more transmission lines; and phase delaying the divided signal in a phase delay network comprising a plurality of transmission line elements, each having an electrical length θ longer than a preceding line element and θ shorter than a next line element, where θ=180 degrees divided by n, and n is a number into which the single input signal to be divided.

14. A method of combining output power from two or more devices comprising the steps of:

phase delaying the output power from the two or more devices in a phase delay network comprising a plurality of transmission line elements, each having an electrical length θ longer than a preceding line element and θ shorter than a next line element, where θ=180 degrees divided by n, and n is a number of a total of the two or more devices;

transforming an input characteristic impedances to an intermediate characteristic impedance using two or more transmission lines, each of which has characteristic impedance $Z_{xf2}$ and receives the output power to be combined wherein the intermediate characteristic impedance is an intermediate impedance between the input characteristic impedance and the characteristic impedance of the two or more transmission lines; and collecting power from the two or more devices using a transmission line of characteristic impedance $Z_{xf1}$, wherein n is a number representing a total number of devices, and $Z_{xf1}=Z_{xf2}/n$.

* * * * *